US008177090B2

(12) United States Patent
Al-Farraj

(10) Patent No.: US 8,177,090 B2
(45) Date of Patent: May 15, 2012

(54) STORAGE TANK WITH FLOATING ROOF EMERGENCY DRAINING SYSTEM AND SPHERICAL ROTOR FUME SEALING VALVE

(75) Inventor: Zaid Sulaiman Farraj Al-Farraj, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 381 days.

(21) Appl. No.: 12/384,966

(22) Filed: Apr. 9, 2009

(65) Prior Publication Data

US 2010/0258561 A1 Oct. 14, 2010

(51) Int. Cl.
*B65D 88/38* (2006.01)
*F16K 24/04* (2006.01)

(52) U.S. Cl. ..... 220/219; 220/227; 137/177; 137/202; 137/409

(58) Field of Classification Search ..... 220/219, 220/227; 137/177, 202, 409; 141/86, 88
See application file for complete search history.

(56) References Cited

U.S. PATENT DOCUMENTS 2,913,138 A 8/1957 Swick
3,228,653 A * 1/1966 Trimmer ..... 251/306
3,883,032 A 5/1975 Fisher
3,938,588 A 2/1976 Coit et al.
5,630,691 A 5/1997 Newbolt
5,758,792 A * 6/1998 Jolly ..... 220/219

FOREIGN PATENT DOCUMENTS

EP 0225775 A2 6/1987
EP 0225775 B1 * 6/1987
JP 5077883 (A) 3/1993
JP 2002226052 (A) 8/2002
JP 2002321821 (A) 11/2002
WO WO 91/15418 A1 10/1991
WO WO91/15418 A1 * 10/1991

OTHER PUBLICATIONS

International Search Report, May 21, 2010.

* cited by examiner

*Primary Examiner* — Anthony Stashick
*Assistant Examiner* — Madison L Wright
(74) *Attorney, Agent, or Firm* — Abelman, Frayne & Schwab

(57) ABSTRACT

A combination liquid petroleum storage tank and emergency drainage system for draining rain water accumulated on the floating roof of the storage tank, including a drain duct having an inlet adapted to receive rain water accumulated on the roof and extending downward about a central axis, and a petroleum vapor barrier valve in the drain duct at an axial location downstream of the inlet, the valve formed as a multi-blade rotor that is rotatably mounted in the drain duct for rotation about a central rotor axis extending generally perpendicular to the drain duct central axis at the axial location, the rotor having a plurality of generally semi-circular blades.

20 Claims, 4 Drawing Sheets

Figure 1:
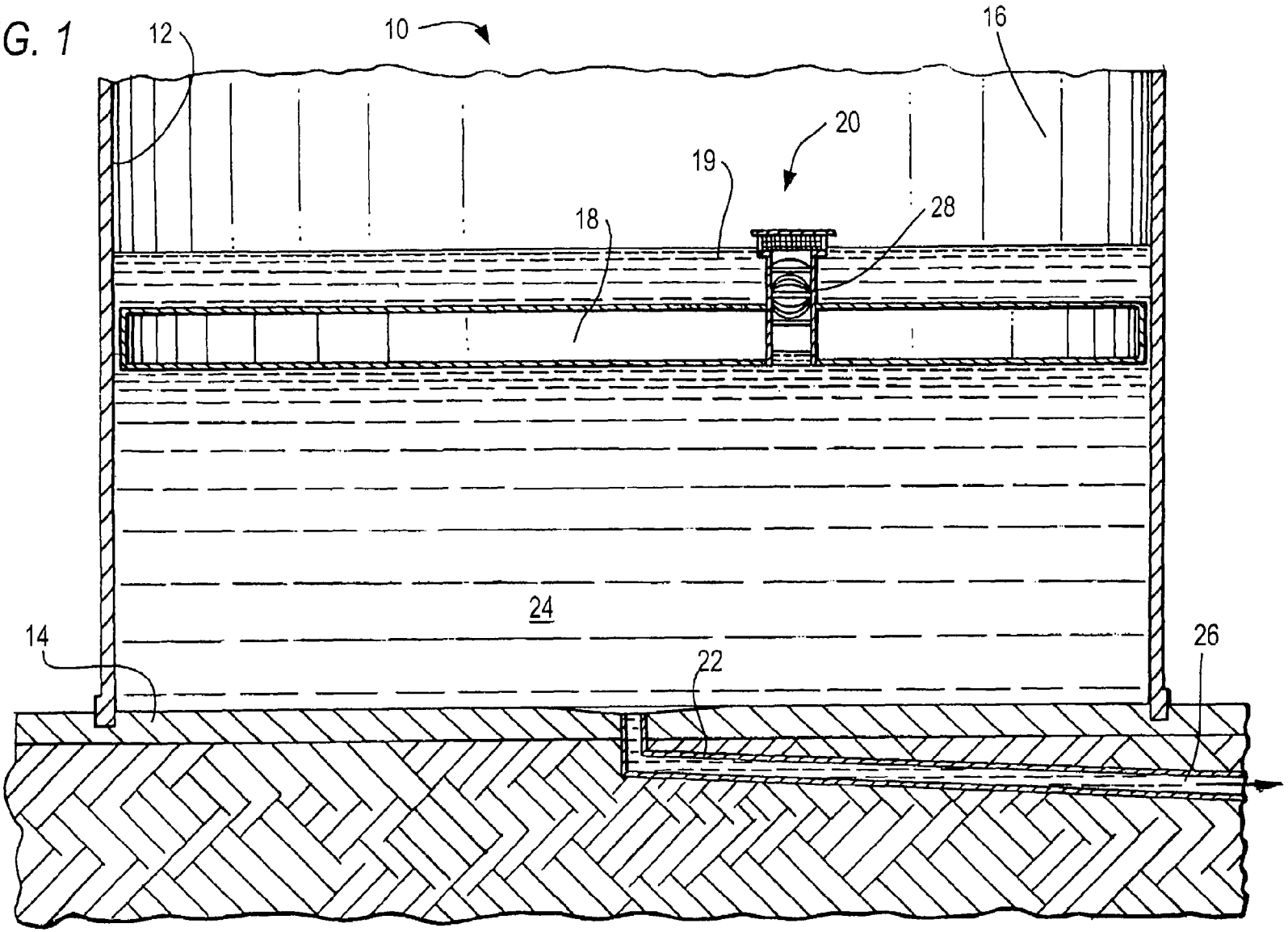

STORAGE TANK WITH FLOATING ROOF EMERGENCY DRAINING SYSTEM AND SPHERICAL ROTOR FUME SEALING VALVE

I. BACKGROUND

A. Field of the Invention

This invention is in the field of storage tanks for liquid products, and particularly liquid petroleum storage tanks each having a floating roof and a drainage system to drain excess accumulation of water on top of the floating roof.

B. Background of the Invention

Certain storage tanks for oil and other liquid petroleum products are provided with a floating roof or double deck roof which covers and protects the liquid product, reduces the escape of harmful vapors, and moves vertically on the surface of the liquid product as its volume changes. A typical floating roof for covering a liquid product in a storage tank includes a deck part whose circumference substantially conforms to the horizontal cross-sectional shape of the storage tank and is provided with one or more seals extending between the outer periphery of the floating roof deck part and the inner walls of the tank. The roof floats on top of the stored liquid product and rises and falls as the amount of the liquid product increases and decreases. It is known to provide a drain pipe extending downward through the top surface of deck, to drain water accumulated on the top of the roof and to provide a passage or conduit for the drained water to flow either into the liquid petroleum in the tank or via a discharge duct downward through and exiting said storage tank.

A problem that occurs with these rain water drain pipes is escape upward through said pipes of fumes from the liquid petroleum in the tank. Even where the drain pipe has a closure valve, fumes can escape if the valve is open without water descending or while the valve is temporarily open to allow water to descend.

Various approaches have been proposed for draining water from storage tank floating roofs. For example, U.S. Pat. No. 2,560,586 to Michaels discloses a floating roof drain which drains water collected over a valve of the floating roof which closes and opens a drain passing. The weight of the water collected over the valve pushes down a cover against the buoyancy force of a float connected to the valve to allow the water collected to flow from the roof. The valve is again closed when the depth of the water on the roof decreases until it is no longer sufficient to hold the valve open against the buoyancy force of the float.

U.S. Pat. No. 2,913,138 to Swick describes floating covers for tanks in which a drainage device is located at a low point of the roof structure in a deck. The drainage device comprises a cylindrical sump, a sump bottom formed with a shallow depression which constitutes a downward flow passage, a cylindrical neck extending from the bottom of the sump and an annular float member loosely surrounding the sidewall of the neck. A mercury seal is provided on the bottom and the float member rests on the bottom of the pool of mercury. Accumulated water in the sump buoys up the float member to interrupt the mercury seal and thereby provide a conduit for water to drain across the surface of the pool.

U.S. Pat. No. 3,883,032 to Fisher discloses an automatic drain valve for a floating roof which includes an orifice and a larger disk located under the orifice. A float attached to the disk allows the valve to be biased closed and water gathered on top of the roof will open the valve which permits the water to drain through the roof into the tank beneath to join the body of liquid product with the tank.

Figure 2:
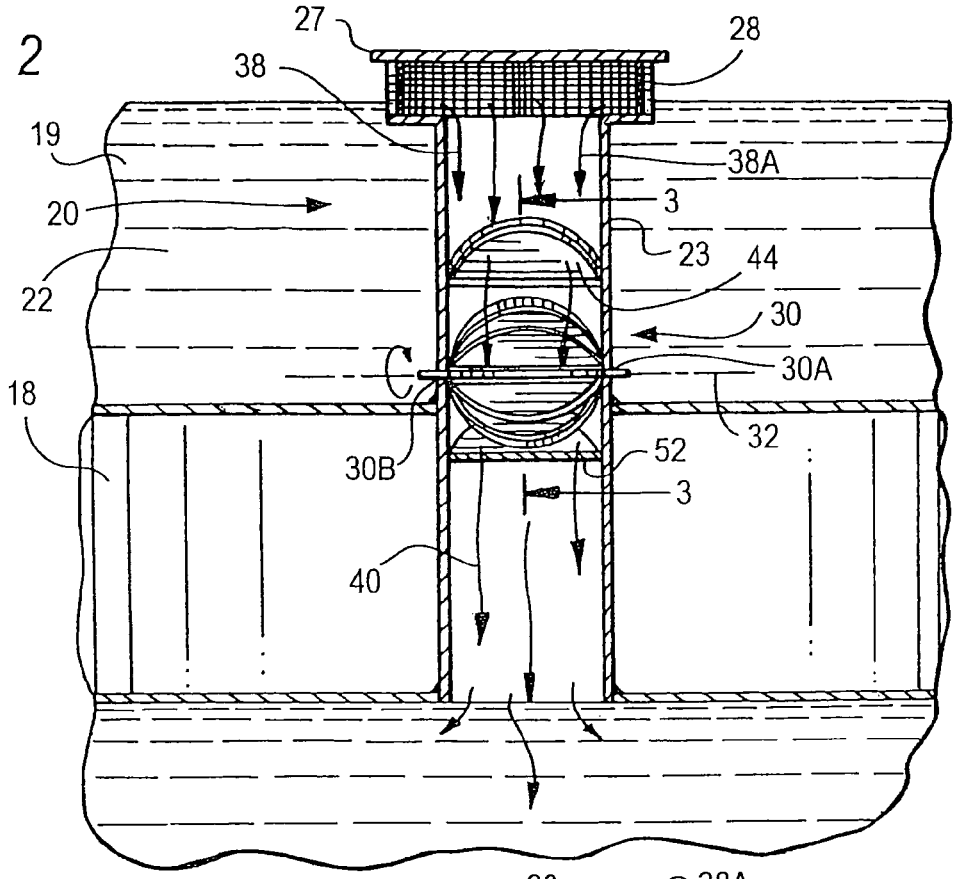

Japanese Patent No. JP5077883 to Kunio discloses in FIG. 1 an emergency drain device for a floating roof in which a drain pipe 8 runs from accumulated water 9 atop the floating roof 1 down through drain pipe 8 into stored liquid 2 in the storage tank. As seen in FIG. 2 float 12 which floats on accumulated liquid 9 on the deck and is at the upper end of the drain pipe 8, prevents vapor from flowing out of the drain pipe. A weight-attached guide member 13 makes the float return down to the upper end of the drain pipe. With this apparatus there remains the possibility for some vapor to escape under a variety of circumstances.

The above systems for draining water from floating roofs do not overcome the problem of fumes escaping upward while a valve is open to allow accumulated rain water to flow downward through the valve.

It is, therefore, an object of the present invention to provide an apparatus for effectively and reliably draining accumulated rain water from a floating roof on a liquid product tank by a valve mechanism that bars or substantially reduces the escape of petroleum gas fumes when the water drain valve is open.

An additional object is to provide for a floating roof an emergency drainage system which will automatically open under predetermined conditions and automatically bar escape upward of fumes through said valve.

A still further object is to provide an uncomplicated but reliable emergency drainage system which will be normally closed and will automatically open merely from the accumulation of a predetermined head of water on the roof in the vicinity of the emerging drainage valve.

A further object of the invention is to provide an automatic roof drain apparatus that is of simple and rugged construction and inexpensive to manufacture and install.

II. SUMMARY OF THE NEW INVENTION

The above objects, as well as the advantages described herein, are achieved by a new emergency drainage valve installed in a floating roof, with a generally spherical multi-blade rotor rotatable within a duct, the rotor's axis of rotation being generally perpendicular to the duct's central axis.

In one preferred embodiment the rotor is formed by a plurality of semi-circular blades extending radially from the rotor's central axis of rotation.

In another preferred embodiment of the new emergency drain valve the rotor is formed by generally circular blades intersecting to form the spherical rotor.

In a still further preferred embodiment the rotor blades are square or rectangular shaped.

In another preferred embodiment the new valve is adapted for use with a storage tank having a floating roof emergency drainage system.

The present invention includes the new emergency drainage system as described herein for a storage tank for liquid petroleum or other fluids which commonly have escape of vapor from the top surface of the stored liquid.

Various exemplary embodiments of this invention include the following.

1. A combination liquid petroleum storage tank and emergency drainage system for draining rain water accumulated on the roof of said storage tank, comprising:
   a. a storage tank including a roof, side walls and a base which define an interior space,
   b. at least one rainwater drain duct having an inlet adapted to receive rain water accumulated on said roof, said drain duct having walls which define a predetermined bore diameter, said drain duct extending downward about a central axis and communicating with said interior space, c. a petroleum vapor barrier valve in said drain duct at an axial location downstream of said inlet, said valve formed as a multi-blade rotor that is rotatably mounted in said drain duct for rotation about a central rotor axis extending generally perpendicular to said drain duct central axis at said axial location, d. said rotor comprising a central axle means and a plurality of generally semi-circular blades, each of said blades having a body part extending radially outward from said base part to an exposed semi-circular peripheral edge, said exposed edges of said plurality of blades defining a spherical shape having diameter corresponding generally to said bore diameter of said duct at said axial location.

2. Apparatus according to claim 1, further comprising a sealing ring extending around said drain duct bore at said axial location and extending radially inward toward said exposed edges of said rotor blades.

3. An apparatus according to claim 1, wherein said rotor blades are arranged in sets of two oppositely extending coplanar blades, so that any one of said sets of coplanar blades when extending across said duct and perpendicular to said duct central access, will substantially close said duct.

4. An apparatus according to claim 1, wherein said duct extends generally vertically at said axial location where said valve is situated.

5. An apparatus according to claim 1, wherein said rotor is freely rotatable.

6. An apparatus according to claim 1, further comprising an upper baffle situated in said drain duct upstream of said valve and extending from one side of said duct at least half way toward the other side for directing rainwater descending down said duct to flow toward only one side of said valve, to thus cause said rotor to rotate in only one direction.

7. An apparatus according to claim 1, wherein said upper baffle comprises a blade inclined downward.

8. An apparatus according to claim 7 wherein said upper baffle is a curved blade.

9. An apparatus according to claim 1, further comprising an upper baffle in said duct upstream of said valve, said upper baffle comprising a bowl having a top opening of diameter generally the same as that of said duct, and a funnel like bottom opening for directing said descending water to one side of said duct to thus cause said rotor to rotate in only one direction.

10. An apparatus according to claim 1, wherein at any given time half of said blades are positioned to rotate downward and half are positioned to rotate upward, said apparatus further comprising a lower baffle downstream of said valve and extending from one side of said duct about half way toward the other side and situated adjacent and below said blades position to rotate upward, for inhibiting vapor from flowing upward as said rotor blades rotate upward.

11. An apparatus according to claim 10, wherein said lower baffle is a curved plate.

12. An apparatus according to claim 1, wherein each set of oppositely extending blades comprises a single sheet of generally circular shape, and said circular shaped sheets intersect each other.

13. Apparatus according to claim 1, wherein said floating roof has outer circumference generally conforming to the bore surface of said tank's side walls 14. A petroleum fume-sealing valve for an emergency drainage system for draining rain water accumulated on the roof of said storage tank, which tank includes a roof, side walls and a base which define an interior space, and at least one rainwater drain duct having an inlet adapted to receive rain water accumulated on said roof, said drain duct extending downward about a central axis and communicating with said interior space, said valve comprising a multi-blade rotor that is mounted for rotation about a central axis generally perpendicular to said drain duct central axis, said rotor comprising central axle means and a plurality of generally semi-circular blades, each of said blades having a body part extending radially outward from said base to an exposed semi-circular edge, said exposed edges of said plurality of blades defining a spherical shape having diameter corresponding generally to said bore diameter of said duct at said axial location.

15. A valve for inhibiting upward flow of fumes in a duct while allowing downward flow of liquid, comprising a. a duct having an inlet adapted to receive liquid from above said duct and a predetermined bore diameter, b. a multi-blade rotor rotatably mounted in said duct for rotation about a central rotor access extending generally perpendicularly to said duct central axis, c. said rotor comprising a central axle means and a plurality of generally semi-circular blades, each of said blades having a body part extending radially outward from said base part to an exposed semi-circular peripheral edge, said exposed edges of said plurality of blades defining a spherical shape having diameter corresponding generally to said bore diameter of said duct at said axial location.

16. An apparatus according to claim 15, wherein said rotor blades are arranged in sets of two oppositely extending coplanar blades, so that any one of said sets of coplanar blades when extending across said duct, and perpendicular to said duct central access, will substantially close said duct.

17. An apparatus according to claim 15, wherein said rotor is freely rotatable.

18. An apparatus according to claim 15, further comprising an upper baffle situated in said drain duct upstream of said valve and extending from one side of said duct at least half way toward the other side for directing rainwater descending down said duct to flow toward only one side of said valve, to thus cause said rotor to rotate in only one direction.

19. An apparatus according to claim 15, wherein at any given time half of said blades are positioned to rotate downward and half are positioned to rotate upward, said apparatus further comprising a lower baffle downstream of said valve and extending from one side of said duct about half way toward the other side and situated adjacent and below said blades position to rotate upward, for inhibiting vapor from flowing upward as said rotor blades rotate upward.

20. A method of restricting upward flow of petroleum vapor in an emergency drainage duct which has an inlet for receiving rain water accumulated on the roof of a storage tank that contains petroleum liquid and an outlet into said tank, comprising:

a. providing a petroleum vapor barrier valve in said drain duct downstream of said inlet, said valve formed as a multi-blade rotor that is mounted for rotation about a central axis generally perpendicular to said drain duct central axis, b. said rotor comprising a central axle and a plurality of generally semi-circular blades, each of said blades having a base adjacent the rotor's axle, a body part extending radially outward from said base to an exposed semi-circular edge, said exposed edges of said plurality of blades defining a spherical shape having diameter corresponding generally to said bore diameter of said duct through which extends the rotor's axle.

Other objects and advantages of the present invention will become apparent from the detailed description given hereinafter. Thus, it should be understood that the detailed description and specific embodiments are given by way of illustration only, since various changes and modifications within the spirit and scope of the invention will become apparent to those skilled in the art from this detailed description.

III. BRIEF DESCRIPTION OF THE DRAWINGS

Figure 3:
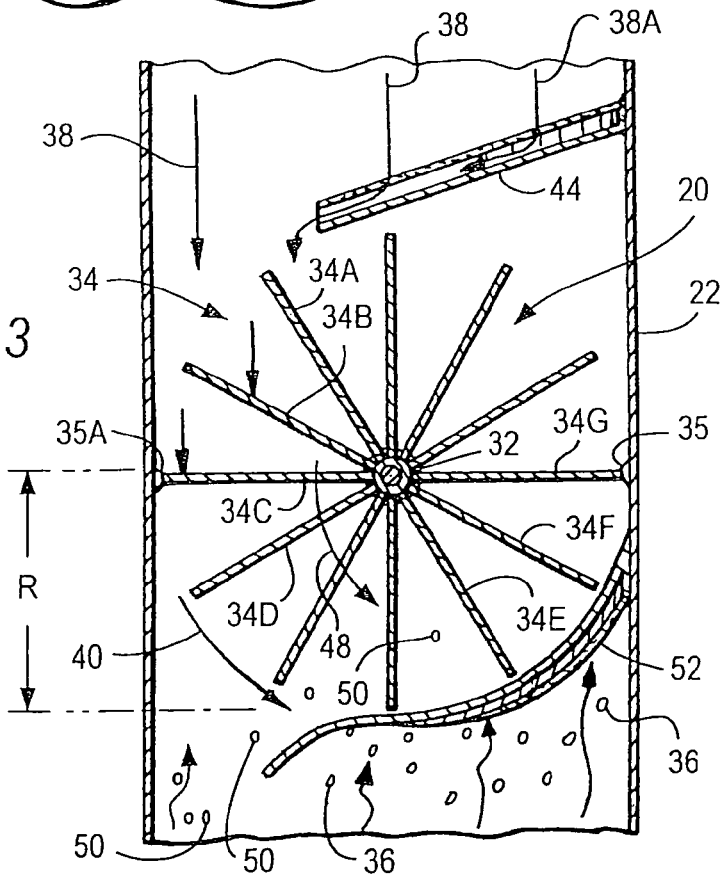
Figure 5:
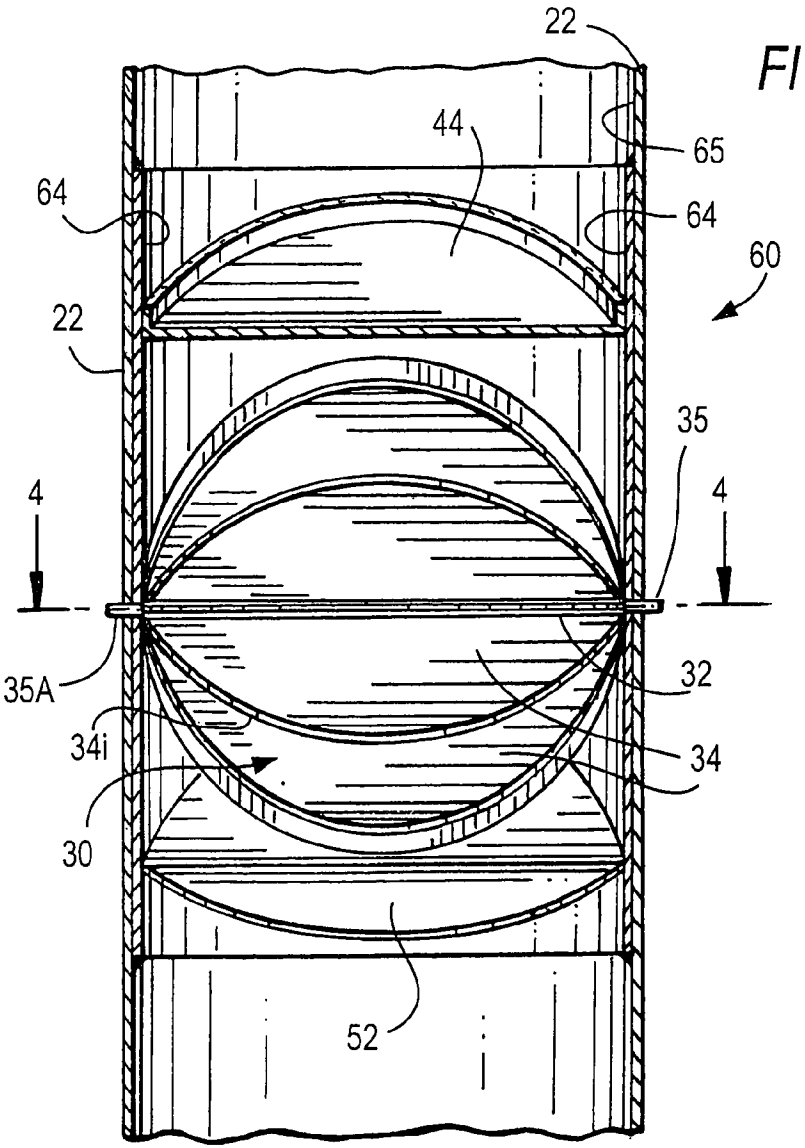
Figure 4:
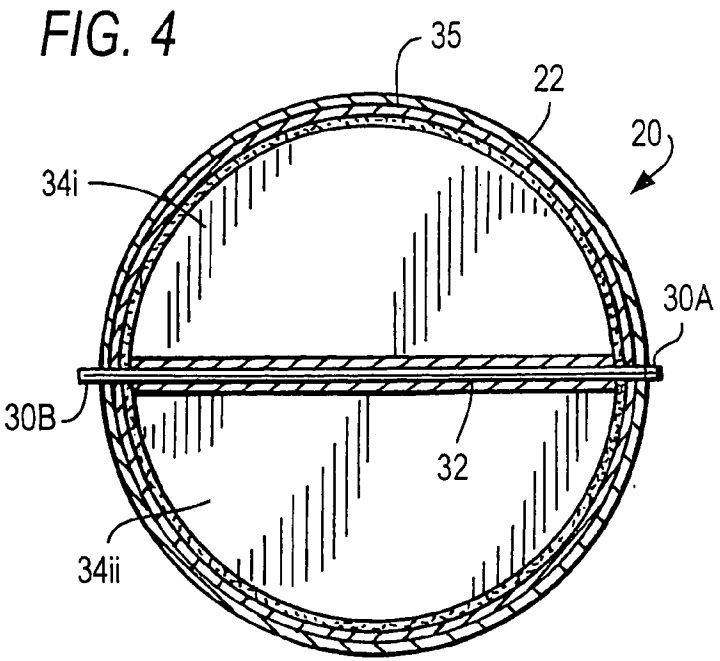
Figure 7:
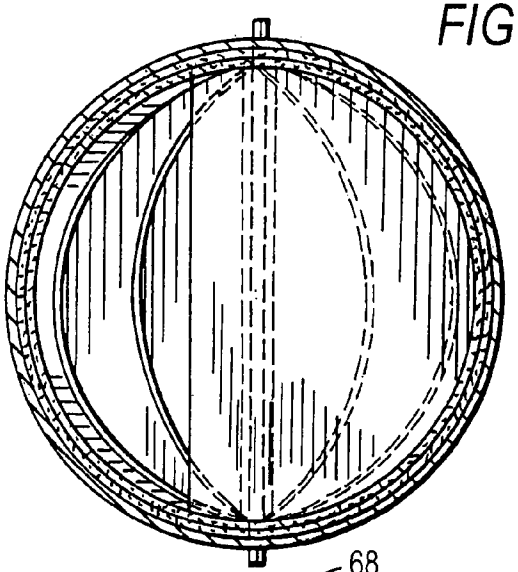
Figure 8:
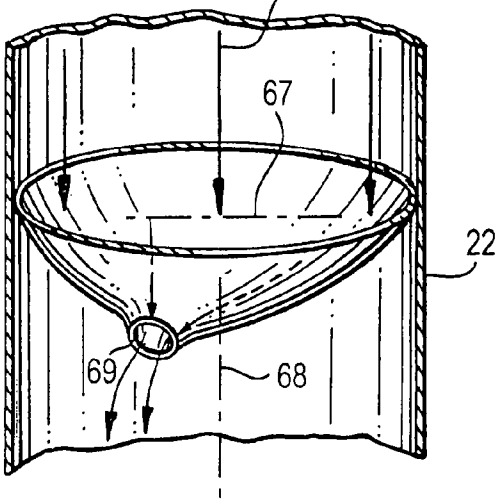
Figure 6:
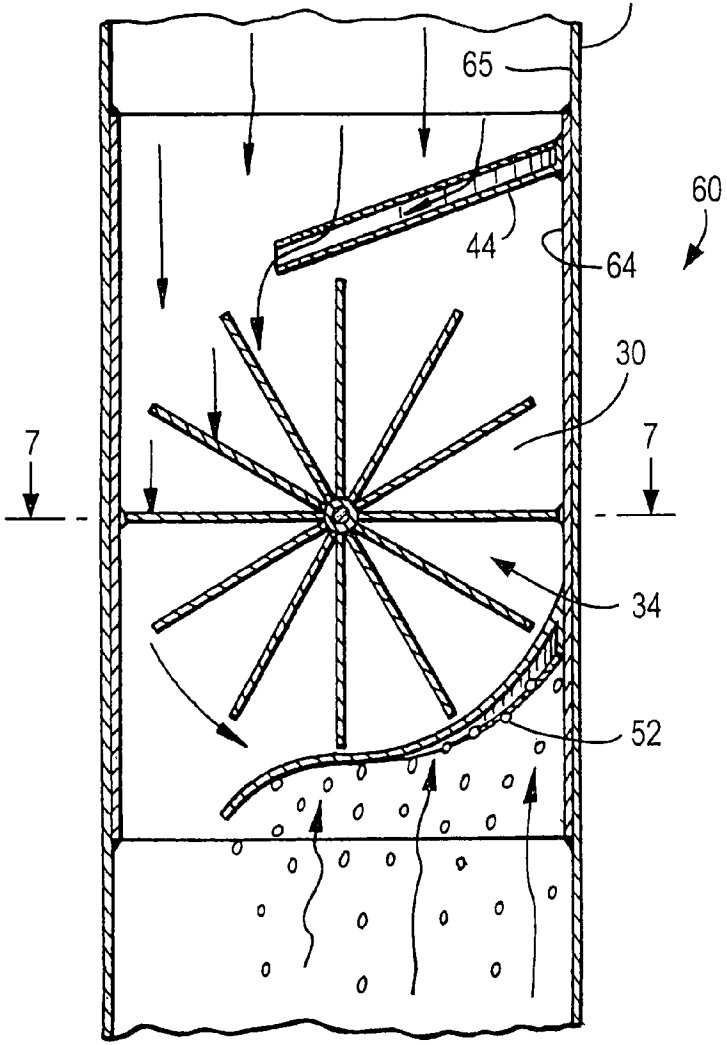

FIG. 1 is a elevation view in section of a storage tank with the new spherical impeller fume sealing valve, FIG. 2 is an enlarged fragmentary elevation view partially in section of the new spherical impeller fume sealing valve of FIG. 1, FIG. 3 is a fragmentary end elevation view in section of the valve of FIG. 1, FIG. 4 is a top, plan view in section of the valve of FIGS. 1-3, FIG. 5 is a side elevation view second embodiment of the new spherical impeller sealing valve shown as an elevation view in section, FIG. 6 is an end elevation view of the valve of FIG. 5, FIG. 7 is a top plan view in section of the valve of FIGS. 5 and 6, and FIG. 8 is top perspective view of a further embodiment of a baffle for optional use in a spherical valve of FIGS. 1-3.

IV. DETAILED DESCRIPTION OF THE PREFERRED EMBODIMENTS

For convenience and clarity in describing these embodiments, similar elements or components appearing in different figures will have the same reference numbers.

The preferred embodiment of the new floating roof emergency drainage system is illustrated in FIGS. 1-6.

FIG. 1 shows a conventional liquid petroleum fluid storage tank 10 with fixed circumferential walls 12, a closed bottom 14, an open top 16, a floating roof 18, accumulated water 19 is on the roof, the new emergency drainage valve 20, and a conventional drainage duct 22 extending from said emergency drainage valve 20 downward into stored liquid petroleum 24 on further downward to the bottom drainage outlet 26.

FIG. 2 shows an enlarged elevation view of the new valve 20 mounted within drainage duct 22 which extends upward in a section designated 23 which extends further upward above roof 18. Section 23 has a sealing part 27 and openings 28 extending transversely to allow accumulated water to flow into duct 22 and downward to the new valve 20.

Valve 20 is formed as a spherical impeller blade device 30 that rotates about axis 32 extending horizontally through duct 22. The spherical impeller is mounted for rotation about its central axis 32 through bearings (not shown) secured to walls of duct 22. FIG. 3 shows the impeller 20 in end elevation view within the circular walls of duct 22, and FIG. 4 shows a top plan view of valve 20 within said circular walls of drain duct 22, the valve being rotatable about axis 32 extending transversely through duct 22 as shown.

The spherical valve of FIGS. 2-4 has flat semi-circular blades 34 which are shown to be equally spaced at 30-degree intervals; however, other numbers of blades are possible. As seen in FIG. 3, the radius R of each blade is established to be approximately half of the diameter of said drainage duct 22, so that in any rotation position of the impeller, such as seen in FIG. 3, a peripheral edge of a blade will engage a seal 35, 35A and effectively block movement of petroleum vapor 36 from travelling upward past valve 20 and thence further upward into the atmosphere. As seen in FIG. 4 which is a top plan view in section, one set of opposite semi-circular blades 34*i*, 34*ii* establishes a horizontal plane within the round cross-sectional opening of duct 22, with a vapor barrier established between the peripheral edges of those blades and the seal element 35, 35A which is effectively a ring extending around the bore of duct 22.

Spherical impeller device 30 has these blades mounted about its own rotational axis 32 which extends through an axle (not shown) or through bearings at the intersection of ends 30A and 30B of the impeller valve seen in FIGS. 2 and 4.

The operation of the valve is as follows. When water 19 accumulates on the roof 18, as seen in FIGS. 1 and 2 for example, this water flows through openings 28 and then flows downward as indicated by arrows 38 on to valve 20. Such water striking blades 34 of valve 20 will automatically cause the impeller to rotate counterclockwise, for example, so that water can and will travel downward to an area indicated by arrow 40 and thence continue downward through duct 22.

As seen in FIG. 3 water from the roof overflow, flowing downward as indicated in arrows 38A, will strike baffle 44 and be directed in a leftward direction as shown by the lead ends of arrows 38A; water indicated by arrow 38 falling left of baffle 44 along with water flowing off the baffle strikes impeller blades only to the left of center as shown, thus causing the impeller to rotate only in a counterclockwise direction indicated by arrow 48. By this baffle arrangement as shown, downward flowing water cannot go to both left and right sides of the blades, which could cause a stalemate of clockwise and counterclockwise forces and a standstill of the impeller or rotor, with an equal amount of water on each side of the rotation axis.

As water flows downward on the left side of the valve, namely against and about blades 34*a*, 34*b*, 34*c* and 34*d*, the opposite blades 34*e*, 34*f* and 34*g* are continuing to rotate counterclockwise in an upward direction where each one of the blades, on its turn contacts seal element 35, 35A.

The combination of sealing by seal element 35 on the upstroke and by seal element 35A on the downstroke, on the left side as seen in FIG. 3, establishes a 360° seal completely around the opening of drain duct 22. This seal is established to reduce upward flow of vapor 36 through the valve while water is descending downward through the valve. Clearly, if the valve rotation is stopped at a position where a set of oppositely extending blades establishing a horizontal plane has their peripheral edges engage the seal in the 360° arrange the seal, this will bar water vapor from escaping upward while the valve is fully closed and not moving.

Since there remains the possibility of some vapor 36 escaping upward while the valve is rotating counterclockwise on the right side as seen in FIG. 3, where vapor could flow into the area marked by vapor symbols 50. Such escape is minimized by the seal at 35, and it is further minimized by lower baffle 52 which tends to block vapor indicated by vapor symbols 54 from moving into the area earlier indicated by vapor symbols 50. Escape of vapor 36 upward on the left side in FIG. 3 is unlikely since the blades are moving downward against such vapor flow and because water is flowing down in the space to block upward flow of the vapor, and finally there is the seal 35A which intermittently totally blocks flow in either direction.

FIGS. 5 and 6 illustrate a second embodiment of the new impeller valve 60 invention mounted in its own circular tubular housing 64 which is then mounted within the bore 65 of drain duct 22. In this manner, the valve can be an independent, fully assembled and transportable for mounting into a drain duct 22, as opposed to a valve impeller being mounted directly into the walls of a drain duct as seen in FIGS. 2 through 4. The valve of FIGS. 5 and 6 includes components essentially the same as those in FIGS. 2 through 4, namely the spherical impeller blade device 30 (with the same reference numbers as before), semi-circular blades 34, rotation axis 32 and seal elements 35 and 35A. This embodiment also includes the same or essentially the same upper baffle 44 and lower baffle 52. The second embodiment functions essentially the same as the first one, with downward flow of water directed by baffle 44 onto the left side blades, as seen in FIG. 6, and with petroleum gas vapors substantially blocked from upward flow by lower baffle 52 and seals 35 and 35A.

FIG. 8 illustrates a further embodiment of an upper baffle 67 which is essentially a semicircular plate extending at least slightly more than halfway past central axis 68 of duct 22 to ensure that downward flowing water is directed only to the left side of the spherical impeller. Baffle 67 is formed as a dish extending 360° around, so that it can accumulate or capture water flowing down from any location around 360° of the drain duct 22. All the water captured is then directed via the bottom funnel shape 69 to the left side of the spherical impeller as discussed earlier in connection with the baffle 44. Thus, this baffle 67 could replace baffle 44 in the apparatus shown in FIGS. 2 through 4 and/or FIGS. 5 and 6.

A still further variation applicable in FIG. 5, for example, would be a ratchet device (not shown) associated with the bearing about which the spherical valve impeller rotates. Such ratchet would allow rotation of the impeller only in one direction for the purpose of allowing the impeller valve to rotate only when water is flowing downward and otherwise to remain closed, to thus minimize any upward flow of petroleum fumes.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

The invention claimed is:

1. A combination liquid petroleum floating roof storage tank and emergency drainage system for draining rain water accumulated on the roof of said storage tank, comprising:

a. a storage tank including a floating roof, side walls having a circumferential inner surface and a base which define an interior space, b. at least one rainwater drain duct having an inlet adapted to receive rain water accumulated on said roof, said drain duct having walls which define a predetermined generally round bore diameter, said drain duct extending downward about a central axis and communicating with said interior space, c. a petroleum vapor barrier valve in said drain duct at an axial location downstream of said inlet, said valve formed as a multi-blade rotor that is rotatably mounted in said drain duct for rotation about a central rotor axis extending generally perpendicular to said drain duct central axis at said axial location, d. said rotor comprising a central axle means and a plurality of generally semi-circular blades, each of said blades having a base and a body part extending radially outward from said base to an exposed semi-circular peripheral edge, said exposed edges of said plurality of blades defining a generally spherical shape having diameter corresponding generally to said round bore diameter of said duct at said axial location.

2. Apparatus according to claim 1, further comprising a sealing ring extending around said drain duct bore at said axial location and extending radially inward toward said exposed edges of said rotor blades.

3. An apparatus according to claim 1, wherein said rotor blades are arranged in sets of two oppositely extending coplanar blades, so that any one of said sets of coplanar blades when extending across said duct and perpendicular to said duct central access, will substantially close said duct.

4. An apparatus according to claim 1, wherein said duct extends generally vertically at said axial location where said valve is situated.

5. An apparatus according to claim 1, wherein said rotor is freely rotatable.

6. An apparatus according to claim 1, further comprising an upper baffle situated in said drain duct upstream of said valve and extending from one side of said duct at least half way toward the other side for directing rainwater descending down said duct to flow toward only one side of said valve, to thus cause said rotor to rotate in only one direction.

7. An apparatus according to claim 1, wherein said upper baffle comprises a blade inclined downward.

8. An apparatus according to claim 7 wherein said upper baffle is a curved blade.

9. An apparatus according to claim 1, further comprising an upper baffle in said duct upstream of said valve, said upper baffle comprising a bowl having a top opening of diameter generally the same as that of said duct, and a funnel like bottom opening for directing said descending water to one side of said duct to thus cause said rotor to rotate in only one direction.

10. An apparatus according to claim 1, wherein at any given time half of said blades are positioned to rotate downward and half are positioned to rotate upward, said apparatus further comprising a lower baffle downstream of said valve and extending from one side of said duct about half way toward the other side and situated adjacent and below said blades position to rotate upward, for inhibiting vapor from flowing upward as said rotor blades rotate upward.

11. An apparatus according to claim 10, wherein said lower baffle is a curved plate.

12. An apparatus according to claim 1, wherein each set of oppositely extending blades comprises a single sheet of generally circular shape, and said circular shaped sheets intersect each other.

13. Apparatus according to claim 1, wherein said floating roof has an outer circumference generally conforming to said circumferential inner surface of said tank's side walls.

14. A petroleum fume sealing valve for an emergency drainage system for draining rain water accumulated on a floating roof of a storage tank, which tank includes a floating roof, side walls and a base which define an interior space, and at least one rainwater drain duct having an inlet adapted to receive rain water accumulated on said roof, said drain duct extending downward from said floating roof about a central axis and communicating with said interior space, said valve comprising a multi-blade rotor that is mounted for rotation about a central axis generally perpendicular to said drain duct central axis, said rotor comprising a central axle and a plurality of generally semi-circular blades, each of said blades having a body part extending radially outward from said central axle to an exposed semi-circular edge, said exposed edges of said plurality of blades defining a spherical shape having diameter corresponding generally to said bore diameter of said duct at said axial location.

15. A valve for inhibiting upward flow of fumes in a duct while allowing downward flow of liquid, comprising:

a. a duct having an inlet adapted to receive liquid from above said duct and a predetermined bore diameter, b. a multi-blade rotor rotatably mounted in said duct for rotation about a central rotor access extending generally perpendicularly to said duct central axis, c. said rotor comprising a central axle and a plurality of generally semi-circular blades, each of said blades having a body part extending radially outward from said central axle to an exposed semi-circular peripheral edge, said exposed edges of said plurality of blades defining a spherical shape having diameter corresponding generally to said bore diameter of said duct at said axial location.

16. An apparatus according to claim 15, wherein said rotor blades are arranged in sets of two oppositely extending coplanar blades, so that any one of said sets of coplanar blades when extending across said duct, and perpendicular to said duct central access, will substantially close said duct.

17. An apparatus according to claim 15, wherein said rotor is freely rotatable.

18. An apparatus according to claim 15, further comprising an upper baffle situated in said drain duct upstream of said valve and extending from one side of said duct at least half way toward the other side for directing rainwater descending down said duct to flow toward only one side of said valve, to thus cause said rotor to rotate in only one direction.

19. An apparatus according to claim 15, wherein at any given time half of said blades are positioned to rotate downward and half are positioned to rotate upward, said apparatus further comprising a lower baffle downstream of said valve and extending from one side of said duct about half way toward the other side and situated adjacent and below said blades positioned to rotate upward, for inhibiting vapor from flowing upward as said rotor blades rotate upward.

20. A method of restricting upward flow of petroleum vapor in an emergency drainage duct which has an inlet for receiving rain water accumulated on a roof of a storage tank that contains petroleum liquid and has an outlet into said tank, comprising:

a. providing a petroleum vapor barrier valve in said drain duct having a bore of predetermined diameter downstream of said inlet, said valve formed as a multi-blade rotor that is mounted for rotation about a central axis generally perpendicular to said drain duct central axis, b. said rotor comprising a central axle and a plurality of generally semi-circular blades, each of said blades having a base adjacent the rotor's axle, a body part extending radially outward from said base to an exposed semi-circular edge, said exposed edges of said plurality of blades defining a spherical shape having diameter corresponding generally to said predetermined bore diameter of said duct through which extends the rotor's axle.

* * * * *